United States Patent [19]

Lopez

[11] 3,964,686

[45] June 22, 1976

[54] SHOWERHEAD WITH SECONDARY LIQUID DISPENSER

[75] Inventor: Victor D. Lopez, Woodside, N.Y.

[73] Assignee: Lawrence Peska Associates, Inc., New York, N.Y. ; a part interest

[22] Filed: Apr. 10, 1975

[21] Appl. No.: 567,000

[52] U.S. Cl. ..... 239/74; 239/315

[51] Int. Cl.[2] ..... B05B 7/24

[58] Field of Search ..... 239/310, 315, 316, 71, 239/74

[56] References Cited

UNITED STATES PATENTS

| | | | |
|---|---|---|---|
| 2,504,506 | 4/1950 | Du-For | 239/315 |
| 2,580,696 | 1/1952 | Novak | 239/74 |
| 2,584,631 | 2/1952 | Soss | 239/316 X |
| 2,620,234 | 12/1952 | Schaich | 239/315 X |
| 2,795,460 | 6/1957 | Bletcher et al. | 239/315 UX |
| 3,788,553 | 1/1974 | Heckman | 239/315 |

*Primary Examiner*—John J. Love

[57] ABSTRACT

A shower head for shower baths including a compartment in which a hygienic liquid may be stored and selectively mixed into the water stream. A normally closed valve is positioned in the compartment and a valve operator disposed outside the shower head may selectively open the valve to dispense the liquid.

9 Claims, 2 Drawing Figures

SHOWERHEAD WITH SECONDARY LIQUID DISPENSER

BACKGROUND OF THE INVENTION

This invention relates to showerhead attachments for shower baths and more particularly to a showerhead of this type wherein a quantity of a hygienic liquid may be selectively introduced into the stream of water flowing therethrough.

The inclusion of a hygienic liquid such as skin softening lotions, oils, or colognes into a tub bath is well known. In this manner the liquid can be dispersed over the entire body. This luxury, however, does not appear to be presently available to those who prefer the convenience and speed of a standing shower bath. The feature of introducing such liquids into the water stream while showering should add to the other conveniences of the shower bath. Moreover, since many people wash or shampoo their hair while showering, the capacity to introduce liquid shampoo into the stream of water would be additionally desirable.

SUMMARY OF THE INVENTION

Accordingly, it is a primary object of the present invention to provide a showerhead attachment that is capable of dispensing a hygienic liquid into the water stream.

It is a further object of this invention to provide a showerhead that includes a reservoir for storing a quantity of hygienic liquid and a dispensing means for selectively introducing the liquid into the water stream.

It is another object of this invention to provide a showerhead having a liquid storage reservoir and a valve means for selectively dispensing a controlled amount of the liquid into the stream of water.

The above objects as well as others, which will subsequently become clear, are achieved by providing a shower head attachment with a fillable reservoir for storing a hygienic liquid and a valve normally closing an orifice communicating the reservoir with the interior of the showerhead and operable to selectively open the orifice to dispense the liquid into the water stream. In the preferred embodiment the reservoir is formed in a thickened wall portion of the shower head body and a raised boss formed on the exterior of the body, and the valve includes a stem having an operator extending out of the shower head and biased into the closed position. Depression of the operator opens the valve to introduce liquid into the stream of water flowing in the shower head.

BRIEF DESCRIPTION OF THE DRAWINGS

Other objects and advantages of the invention will best be understood upon reading the following detailed description of the invention with the accompanying drawings, in which.

DETAILED DESCRIPTION OF THE PREFERRED EMBODIMENT

Figure 2:
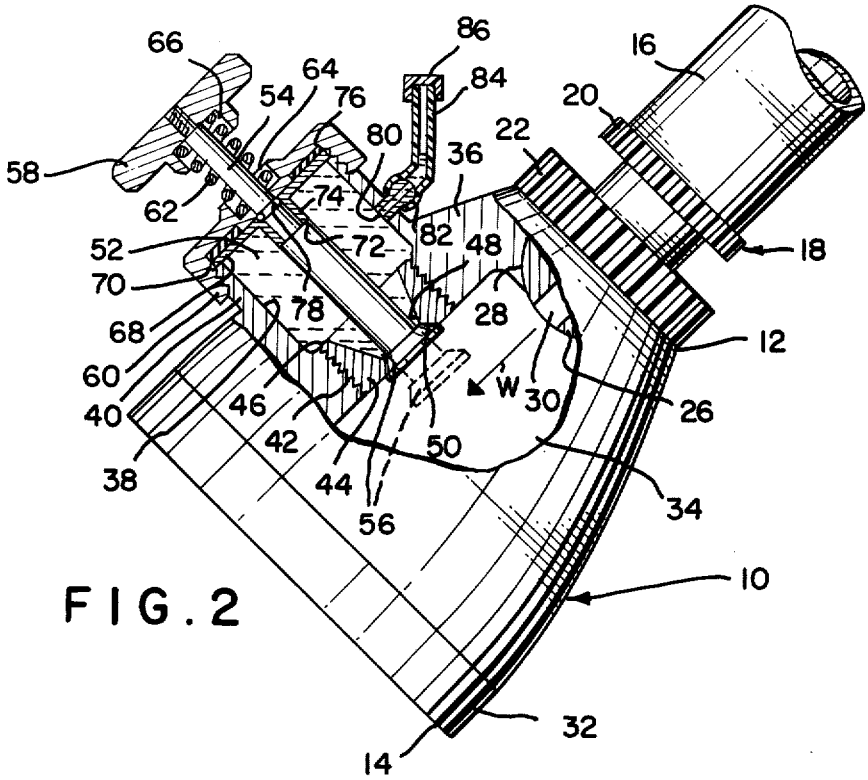
FIG. 2 is a view similar to FIG. 1 with parts thereof broken away and in section for clarity in illustrating the invention.
Figure 1:
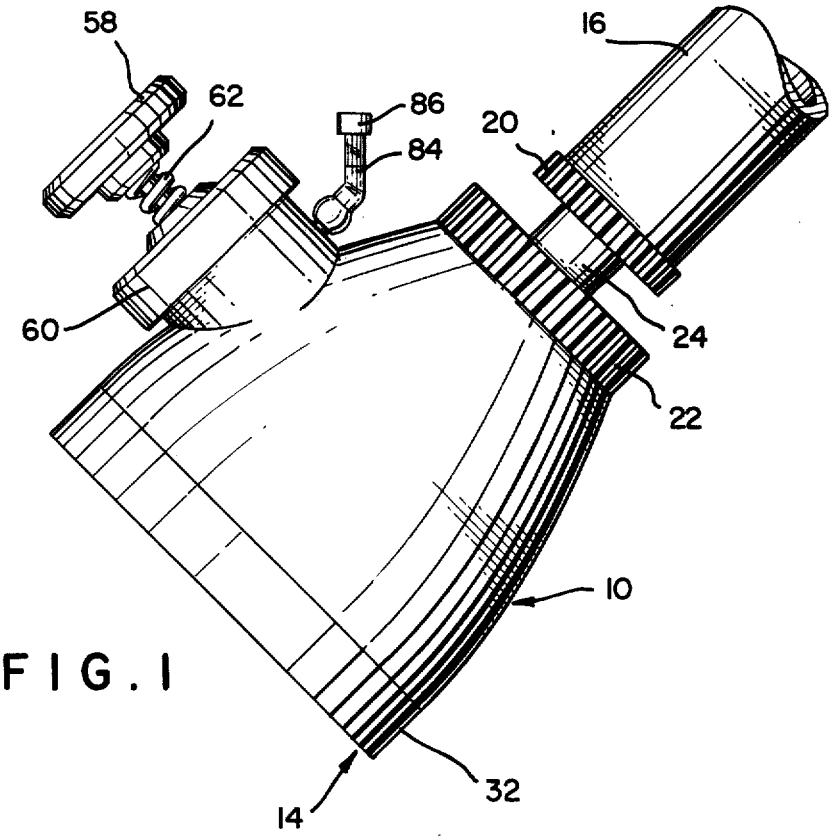
FIG. 1 is an elevational view of a shower head constructed in accordance with the principles of the present invention.

Referring now to the drawings, there is illustrated a shower head generally indicated at 10 and comprising a hollow casting or body structure diverging in configuration from an inlet end 12 to an outlet end 14. The shower head may be connected to a conventional plumbing fixture such as water pipe 16 by means of a coupling 18 having a fitting 20 threaded onto the pipe and a collar 22 threaded onto the inlet end of the shower head. The coupling 18 may include a conduit 24 on the end of which is a bulbous or spherical portion 26 slidably received in a similarly shaped seat 28 sealed with rubber or the like. The ball and seat both, of course, have a passageway 30 through which the water may flow. The collar is loosely fitted about the ball 26 so the collar and the shower head can pivot with a universal swiveling motion to direct the water as desired. The outlet end 14 of the shower head includes a nozzle 32 which may be a conventional adjustable perforated plate or plurality of adjustable slit heads received in apertures, neither of which is illustrated, so that the spray of water may be controlably dispersed.

Intermediate the inlet end 12 and the outlet end 14 is a water dispersing chamber 34. In accordance with the preferred embodiment a wall 36 at one side of the shower head body in the vicinity of the chamber 34 is enlarged or thickened relative to the remainder of the body. Formed in this thickened wall 36 is a bore or cavity 38 that opens into the chamber 34 and which may be continuous with the hollow of an annular boss 40 that may be formed on the surface of the shower head. Preferrably, the wall of the cavity 38 adjacent the chamber 34 is threaded at 42 to receive an externally threaded sleeve 44. The sleeve 44 has a central bore tapering in converging fashion from its upper portion 46 to a narrow orifice 48 and thence tapering in diverging fashion to an outer aperture 50 opening into the chamber 34. The cavity 38 together with the converging bore of the sleeve 44 form a reservoir for the storage of a hygienic liquid 52 such as skin softening lotions, cologne, shampoo or the like which may be dispensed into the water dispersing chamber 34 through the orifice 48. The purpose of the diverging section of the bore will hereinafter become clear.

In order to selectively dispense the liquid 52 from the reservoir the present invention provides a valve including a valve stem 54 extending centrally through the one end at a reservoir and connected at one end to a valve head 56 adjacent the chamber 34 and at the opposite end to an operator 58. The valve head 56 is positioned on the chamber side of the orifice and is tapered so as to be of a substantially truncated conical configuration of a size to fit within the diverging section of the bore of sleeve 44. The diverging section thus functions as a valve seat for the valve head 56 and may be of a material or coated with a material that acts to seal the bore when the valve head 56 is received therein. To enclose the reservoir there is provided a closure member which may comprise an internally threaded bonnet 60 adapted to be threadedly received on the upper portion of the boss 40. A slow return or delayed action spring 62 is coiled about the upper end of the stem 54 and is received within a recess 64 in the upper central wall of the bonnet 60 and a recess 66 in the bottom wall of the operator 58. The spring acts between the operator and the bonnet to urge the operator outwardly from the shower head, and thereby biases the valve head 56 into sealed position with the diverging portion of the bore of the sleeve 44 so as to close the orifice 48. Depression of the operator forces the stem 54 through the orifice and the valve head into the chamber 34 so as to open the orifice into the chamber.

Preferably a bushing 68 is positioned on a circumferential ledge 70 countersunk in the upper annulus of the boss 40 so as to provide a bearing surface for the stem 54. The stem 54 may be stepped as at 72 to act as a stop against a central annular portion 74 of the bushing 68 to prevent the valve head 56 from taking all the forces when the operator is released after depression. A gasket or washer 76 may be positioned between the outer circumferential edge of the bushing and the wall of the bonnet to prevent leakage of liquid past the bushing and down the threads of the bonnet. A further seal in the form of an "O" ring 78 may be positioned in a recess about the central bore of the bushing and the reduced portion of the valve stem 54.

In order to fill the reservoir and replenish the liquid therein when necessary, a passageway 80 is formed through a wall of the boss 40. The passageway 80 extends through a coupling 80 which may have a bulbous configuration formed on, or otherwise secured to, the boss. A preferably transparent plastic tube 84 is adapted to be received about the bulbous coupling 80 for universal pivotable movement, yet to provide a seal to prevent liquid, entering the tube, from escaping between the tube and outer surface of the coupling 80. Since the tube is transparent, the level of liquid in the reservoir may be indicated when the tube and the shower head are properly positioned, e.g., in the form illustrated, when the shower head is substantially horizontal and the tube is vertical. A cap 86 may be positioned on the open end of the tube 84 to prevent spillage when the shower head is pivoted.

In operation, when liquid L is desired to be mixed into the water W flowing through the chamber 34, the operator is depressed momentarily. Since the spring 62 returns slowly the liquid is dispensed over a longer period of time than the period of depression. Alternatively, the operator may be held for as long as required. Thus, the liquid is mixed with the water to be dispersed over the body of a shower bather.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a showerhead comprising a hollow body member having an inlet at one end for connecting to a plumbing conduit to receive a stream of water, an outlet spaced from the inlet for discharging the water, and a dispensing chamber defined intermediate said inlet and outlet, a thickened wall portion formed in the body member in the vicinity of said dispensing chamber, a reservoir comprising a cavity formed in said thickened wall portion and closure means for enclosing said cavity for storing a hygienic liquid, said thickened wall portion including an annular boss raised on the exterior of the body member, said boss having a passageway formed through a wall thereof, a filler port including a hollow tube disposed externally of the body member communicating with the reservoir for supplying liquid to the reservoir, coupling means connecting said tube to the boss with the hollow of the tube opening into the passageway, said reservoir having an orifice opening into said chamber, a valve normally closing the orifice, and a valve operator for selectively moving the valve to open the orifice to dispense said liquid into the chamber, whereby a controlled amount of said liquid is mixed with and discharged with the water.

2. In a shower head as recited in claim 1 wherein said valve comprises a valve head adapted to seal said orifice, a rod having one end connected to the valve head and a second end disposed outside the body member, said operator being secured to the second end of said rod, and biasing means for urging said valve head into sealing relation with said orifice.

3. In a shower head as recited in claim 1 wherein said valve comprises a valve head adapted to seal said opening, a rod having one end connected to the valve head and a second end disposed outside the body member, said operator being secured to said second end, and a spring disposed between and abutting said operator and said closure means for urging said operator and thereby said valve head into sealing relation with the orifice.

4. In a shower head as recited in claim 1 wherein said reservoir includes a sleeve positioned in the cavity adjacent the chamber, said orifice comprising a narrow opening in the sleeve.

5. In a shower head as recited in claim 3 wherein said valve head is positioned in said dispersing chamber, said rod being smaller than the orifice so as to pass freely therethrough and said spring is a coil spring normally urging the operator away from said closure means.

6. In a shower head as recited in claim 1 wherein said tube comprises a transparent plastic material, and said coupling means includes means for mounting said tube for universal pivotable movement relative to said boss.

7. In a showerhead comprising a hollow body member having an inlet at one end for connecting to a plumbing conduit to receive a stream of water, an outlet spaced from the inlet for discharging the water, and a dispensing chamber defined intermediate said inlet and outlet, a thickened wall portion formed in the body member in the vicinity of said dispensing chamber, a reservoir comprising a cavity formed in said thickened wall portion and closure means for enclosing said cavity for storing a hygienic liquid, a filler port communicating with the reservoir for supplying liquid to the reservoir, said reservoir including a sleeve positioned in the cavity adjacent the chamber, said sleeve having an orifice opening into said chamber, a valve comprising a valve head, a rod having one end connected to the valve head and a second end disposed outside the body member, a spring for urging said valve head into normally sealing relationship with the orifice, and a valve operator secured to the second end of said rod for selectively moving the valve head to open the orifice to dispense said liquid into the chamber, whereby a controlled amount of said liquid is mixed with and discharged with the water.

8. In a showerhead as recited in claim 7 wherein said valve head is positioned in said dispensing chamber, said rod being smaller than the orifice so as to pass freely therethrough, and said spring is a coil spring normally urging the operator away from said closure means.

9. In a showerhead as recited in claim 8 wherein said spring is disposed between and abutting said operator and said closure member.

* * * * *